US009273850B2

(12) United States Patent
Onac et al.

(10) Patent No.: US 9,273,850 B2
(45) Date of Patent: Mar. 1, 2016

(54) OPTICAL ELEMENT FOR OBTAINING A DAYLIGHT APPEARANCE, A LIGHTING SYSTEM AND A LUMINAIRE

(75) Inventors: Gabriel-Eugen Onac, Veldhoven (NL); Marcellinus Petrus Carolus Michael Krijn, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 0 days.

(21) Appl. No.: 14/009,901

(22) PCT Filed: Apr. 11, 2012

(86) PCT No.: PCT/IB2012/051764

§ 371 (c)(1),
(2), (4) Date: Oct. 4, 2013

(87) PCT Pub. No.: WO2012/140579

PCT Pub. Date: Oct. 18, 2012

(65) Prior Publication Data

US 2014/0029235 A1 Jan. 30, 2014

(30) Foreign Application Priority Data

Apr. 13, 2011 (EP) ..... 11162237

(51) Int. Cl.
*F21V 9/02* (2006.01)
*F21V 11/06* (2006.01)
*F21W 121/00* (2006.01)

(52) U.S. Cl.
CPC . *F21V 9/02* (2013.01); *F21V 11/06* (2013.01); *F21W 2121/008* (2013.01)

(58) Field of Classification Search
CPC ..... F21V 9/02; F21V 11/06; F21W 2121/008
USPC ..... 362/2
See application file for complete search history.

(56) References Cited

U.S. PATENT DOCUMENTS 2,102,944 A * 12/1937 Doane ..... 362/479
3,124,311 A * 3/1964 Kruger ..... 362/342
4,747,028 A 5/1988 Piotrovsky
4,956,751 A * 9/1990 Kano ..... 362/1

(Continued)

FOREIGN PATENT DOCUMENTS

CN 1965194 A 5/2007
CN 202082790 U 7/2013

(Continued)

*Primary Examiner* — Donald Raleigh
(74) *Attorney, Agent, or Firm* — Meenakshy Chakravorty

(57) ABSTRACT

An optical element for use in front of a light source for obtaining a skylight appearance, a lighting system and a luminaire are provided. The optical element comprises a light transmitting cell which comprises a light transmitting channel, a light input window, a light exit window and a wall. The light transmitting channel collimates a part of light emitted by the light source. The light exit window emits light with the skylight appearance. At least a part of the light exit window is arranged at a second side of the light transmitting channel opposite to the first side. The wall is interposed between the light input window and the part of the light exit window. The wall encloses the light transmitting channel. At least a part of the wall is reflective and/or transmissive in a predefined spectral range to obtain a blue light emission at relatively large light emission angles with respect to a normal to the part of the light exit window.

14 Claims, 7 Drawing Sheets

(56) References Cited

U.S. PATENT DOCUMENTS

| | | | | |
|---|---|---|---|---|
| 7,837,361 | B2 * | 11/2010 | Santoro et al. | 362/355 |
| 2006/0209546 | A1 * | 9/2006 | Ano et al. | 362/311 |
| 2008/0273323 | A1 | 11/2008 | Ladstaetter | |
| 2010/0297415 | A1 | 11/2010 | Cid-Aguilar et al. | |
| 2011/0096548 | A1 * | 4/2011 | Pickard | 362/294 |

FOREIGN PATENT DOCUMENTS

| | | | | |
|---|---|---|---|---|
| FR | 2590652 | A1 * | 5/1987 | F21V 11/06 |
| GB | 697728 | * | 3/1950 | |
| GB | 697728 | | 9/1953 | |
| WO | 2009156347 | A1 | 12/2009 | |
| WO | 2011001367 | A1 | 1/2011 | |

* cited by examiner

OPTICAL ELEMENT FOR OBTAINING A DAYLIGHT APPEARANCE, A LIGHTING SYSTEM AND A LUMINAIRE

FIELD OF THE INVENTION

The invention relates to optical elements which are used to create a daylight appearance.

BACKGROUND OF THE INVENTION

Published patent application US2008/0273323A1 discloses a specific luminaire design for emitting light which is experienced by users as pleasant light. The luminaire comprises a main light source and an additional light source. The additional light source emits light of a color distribution that is different from the color distribution of the main light source. Light of the main light source and of the additional light source are mixed before being emitted through the main light exit window of the luminaire. Further, a portion of light emitted by the additional light source is guided to the side or the rear of the luminaire for being emitted through an additional light exit window at the side or the rear of the luminaire. Such a luminaire provides an opportunity to emit through the main light exit window white light and also to emit via the additional light exit window light of a different color, for example, blue light.

The luminaire according to the cited patent application has a complicated structure and requires a relatively large number of optical elements, such as, at least two light sources which each emit light of a different color distribution, means to mix the light of both light sources, and a light guiding structure to guide light of the additional light source towards the additional light exit window. Thus, the known luminaire for creating an attractive light emission is relatively expensive.

SUMMARY OF THE INVENTION

It is an object of the invention to provide a more cost-effective optical element for creating a daylight appearance.

A first aspect of the invention provides an optical element as claimed in claim 1. A second aspect of the invention provides a lighting system as claimed in claim 12. A third aspect of the invention provides a luminaire as claimed in claim 14. Advantageous embodiments are defined in the dependent claims.

An optical element for use in front of a light source for obtaining a skylight appearance in accordance with the first aspect of the invention comprises a light transmitting cell. The light transmitting cell comprises a light transmitting channel, a light input window, a light exit window and a wall. The light transmitting channel collimates a part of light emitted by the light source. The light input window is arranged at a first side of the light transmitting channel and receives light from the light source. The light exit window emits light with the skylight appearance. At least a part of the light exit window is arranged at a second side of the light transmitting channel opposite to the first side. The wall is interposed between the light input window and the part of the light exit window. The wall encloses the light transmitting channel. At least a part of the wall is reflective and/or transmissive in a predefined spectral range to obtain a blue light emission at relatively large light emission angles with respect to a normal to the part of the light exit window.

The importance of daylight for living beings has widely been recognized. Daylight influences, for example, the well-being, the physical and mental health, and/or the productivity of people. Within buildings it is not always possible to have daylight available in every space of the building and artificial daylight light sources are widely used in such spaces. Known artificial daylight light sources mainly focus on the parameters of light intensity, color temperature and/or color point, color distribution and slow dynamics for simulating a day/night rhythm. It is the insight of the inventors that other characteristics of daylight are important. Daylight comprises direct sunlight, which is substantially white light that is received at a single light emission angle, and the daylight comprises more bluish light at a plurality of light emission angles. The optical element according to the invention generates a daylight appearance according to this characteristic.

Light which is received via the light input window at least partly passes the light transmitting channel towards the light exit window without impinging on the wall. The part which is transmitted through the optical element without impinging on the wall is, compared to the light distribution emitted by the light source, a distribution with light emission angles which are relatively small with respect to a normal to the light input window. This part of the light of the light source becomes a collimated light beam. The collimated light beam has light with the spectrum of the light source, and only the angle of the angular light emissions distribution has been changed compared to the original light emitted by the light source.

Another part of the light which is received via the light input window impinges on the wall and is reflected by, scattered by and/or transmitted through the wall. At least the part of the wall, where the light impinges on or through which the light is transmitted, is reflective or transmissive in a predefined spectral range. The predefined spectral range is chosen such that a color of the light which is reflected by and/or transmitted through the wall changes towards blue light. In other words, the part of the wall being reflective and/or transmissive in a predefined spectral range absorbs light of colors complementary to blue. Especially, light rays of the light which impinges on the wall generally have an angle to the normal axis to the light input window which is relatively large and generally larger than the angle of light rays which do not impinge on the wall. The angle, with respect to the normal, of light rays that impinge and which are reflected or transmitted through the wall is on average relatively large with respect to the normal to the light exit window. Thus, at the light exit window, light of which the color changed towards blue is emitted at relatively large emission angles, while the light which did not impinge on the wall is collimated and is emitted at relatively small emission angles. It is to be noted that, if the light source emits light along a relatively large surface, also some light rays traveling at relatively small light emission angles and entering the light transmitting channel close to the wall, impinge on the wall. Thus, on average, the light rays which impinge on the wall are emitted at relatively large light emission angles and, on average, the light rays which are emitted by the light source at relatively small light emission angles do not impinge on the wall.

Consequently, the optical element according to the invention emits through the light exit window a light emission distribution which comprises light which has the characteristics of the light of the light source at relatively small light emission angles, and which comprises light of which the color is more blue at relatively large light emission angles. Especially, if the light source emits substantially white light which has a color point close to the black body line in the CIE color space, the light at relatively low light emission angles is experienced by users as direct sun light, and the light at relatively wide light emission angles is experience by users as more blue diffuse light which is present in daylight. Thus, a skylight appearance is obtained.

The optical element has a structure which mainly consists of a wall which encloses the light transmitting channel and which is (at least) partially blue. Thus, the optical element may be manufactured at low costs and may be placed in front of existing light sources and/or luminaries without altering the light source or the luminaire. Thus, the solution is effective, efficient and relatively cheap.

It is to be noted that the light exit window may be larger than the part that is arranged at the second side, because, if the wall is transparent, a part of the wall through which light is emitted becomes a portion of the light exit window. The part of the light exit window arranged at the second side emits the light of the light source that is collimated and bluish light may be emitted through this part as well. If the light exit window also has a part that is not arranged at the second side, through this part at least bluish light is emitted.

Light transmitting means that at least a portion of the light which impinges on the light transmitting entity is transmitted through the light transmitting entity. In the context of the invention, the light transmitting channel does not alter the color of the light of the light source that is collimated, however, this does not implicate that the light transmitting channel is not by definition fully transparent.

In an embodiment, the light transmitting channel is transparent. The light transmitting channel may be filled with air, or another transparent material such as glass or a transparent synthetic material. In yet a further embodiment, the light transmitting channel is a fully enclosed space which is filled with a clear fluid.

In an embodiment, the light input window is arranged parallel to the light exit window. Further, an imaginary centre line of the wall extending from the light input window towards the light exit window is arranged perpendicular to the light input window.

In an embodiment, the optical element comprises a plurality of light transmitting cells. If the optical element has a plurality of light transmitting cells, the optical element is for use in front of a light source or luminaire which has a relatively large light emitting surface. The different light transmitting cells are distributed over space and receive light of other parts of the light emitting surface of the light source or luminaire. Thus, the skylight appearance may be obtained along a larger surface and, thus, the skylight appearance will be better—skylight is also not a local phenomena. Further, the dimensions of the light transmitting cell strongly influence the collimation of the light of the light source. If the light source is not a point source, the dimensions of the light transmitting cell have to increase as well to obtain the daylight appearance. By placing a plurality of light transmitting cells besides each other, each light transmitting cell receives light from a limited sub-area of the light source, and as such their dimensions may be reduced. Thus, the length of the light transmitting cells can be reduced and a relatively thin layer of light transmitting cells can be applied in front of a light source or luminaire which has a relatively large light emitting surface. Thus, the dimensions of the combination of the light source or luminaire and the optical element remain within acceptable limits.

In a further embodiment, a plurality of light transmitting cells is arranged in a raster structure. This means that the light transmitting cells are placed together in a regular pattern, that each light transmitting cell has a plurality of neighboring light transmitting cells, that all the light input windows are faced in a specific direction and, consequently, that all light output windows are facing in another direction being an opposite direction of the specific direction, and, thus, that the optical element becomes a layer of adjacent light transmitting cells. The optical element with a raster structure of light transmitting cells provides a uniform light output along a relatively large area, assuming that the light source provides to all light transmitting cells the same type of light. Further, the optical element may be manufactured very efficiently because adjacent light transmitting cells may share their walls: one side of a wall faces towards a first light transmitting cell and the other side faces towards a second light transmitting cell which is adjacent to the first light transmitting cell.

In another embodiment, a thickness of the walls is smaller than ⅓ of a pitch of the raster structure. The pitch of the raster structure is defined by the distance from a centre point of a light transmitting channel to a center point of the neighboring light transmitting channel. The thickness of the wall is defined as the shortest distance from a surface of the wall facing towards the light transmitting channel to another surface of the wall facing towards a neighboring light transmitting channel. An edge of the wall at the side of the light input window of the light transmitting cells does block a part of the light which is received from the light source. In other words, the light which impinges on the edges is not transmitted into the light transmitting channel of the light transmitting cells and as such not emitted through the light exit windows of the light transmitting cells. This contributes to an inefficiency of the optical element. By keeping the ratio between the thickness of the wall and the pitch of the raster structure smaller than ⅓, the inefficiency is kept within acceptable boundaries. Further, another edge of the walls is visible to the viewer at the side of the light exit windows. The visible edge of the walls may disturb a uniform skylight appearance. As such it is advantageous to keep the thickness of the walls within acceptable limits.

In an embodiment, the thickness of the walls is smaller than ⅕ of the pitch of the raster structure. This results in a higher efficiency and a better skylight appearance. In a further embodiment, the thickness of the walls is smaller than 1/10 of the pitch of the raster structure, which results in even better advantageous effects.

In an embodiment, an edge of the walls facing towards the light source is reflective or diffusely reflective or is white if the edge is diffusely reflective. According to the embodiment, if light impinges on the edge of the walls at the side of the light input window, the light is reflected and not absorbed and may be reflected back to the optical element via the light source or the luminaire. Thus, instead of absorbing light, the edges of the walls facing towards the light source contribute to a recycling of light.

In another embodiment, a subset of the plurality of light transmitting cells have a part of the wall being reflective and/or transmissive in a non-blue spectral range for presenting an image to a user looking towards the optical element at a relatively large viewing-angle with respect to the normal to the light exit window. The non-blue part of the wall is a sub-area of the wall on which light of the light source impinges or is a sub-volume of the wall through which light of the light source is transmitted. Thus, some light transmitting cells of the plurality of light transmitting cells contribute to the skylight appearance, and some other light transmitting cells present an image, which is, for example, an emergency sign. Even the image may contribute to a skylight appearance when the presented image is, for example, an image of clouds, or images of flying birds. It is to be noted that a relatively large viewing angle is an angle with respect to a normal to the light exit window that is larger than 45°. Optionally, by giving different areas of the wall of a single light transmitting cell a different color, different images may be seen if the viewer looks towards the optical element from different directions.

In another embodiment, the optical element is a stretched-out stack of elongated layers. Pairs of successive layers are joined together at a plurality of points. Successive pairs of successive layers are joined together at different points. The layers form the walls of the light transmitting channels, and the light transmitting channels are formed by spaces between two successive layers of the stretched-out stack of elongated layers. The point-wise joining of layers may be carried out by gluing. Such an optical element may be manufactured very efficiently. Elongated stripes of a blue material are successively glued together such that the glue-points of successive pairs of successive layers are different in a direction following the elongated layer, and after the gluing, the stack of elongated layers is stretched-out to obtain the optical element. Further, besides the fact that such a structure may be manufactured efficiently, the embodiment may result in further benefits in the distribution and storages of the optical element. Namely, it is not necessary to stretch out the stack of layers immediately after gluing the layers together. This may also be performed just before the optical element is arranged in front of a light source or luminaire. Thus, after gluing the layers together, the stack may be stored or distributed in its most compact shape.

In an embodiment, a side of the wall facing towards the light transmitting channel is diffusely reflective. Such a wall reflects the light which impinges on the wall back towards the light transmitting channel, and because the wall is blue, blue light is reflected back. Most of this reflected light will exit the light transmitting channel via the light exit window, either directly or after one or more additional reflections. Furthermore, a diffusely reflective side of the wall results in an advantageous spreading of light emission angles of the bluish light. Walls having this characteristic may be manufactured of a large set of materials. Just two possible examples are: a plastic with a blue dye, or a metal on which a blue reflective or blue diffusely reflective coating is applied.

In another embodiment, the wall is light transmitting. If light impinges on the walls and is transmitted through the (blue) walls, the light output of the optical element at relatively large light emitting angels comprises light that passed the light transmitting walls and is consequently more blue (more saturated blue). As such it contributes to the skylight appearance. Several materials may be used, like blue transparent synthetic materials. If a plurality of light transmitting cells is arranged in a raster structure, and if a user views towards the optical element with blue light transmitting walls, the bluish light becomes more (saturated) blue at larger viewing angles. Light impinges on the walls at relatively large light emission angles with respect to a normal axis of the light input window, and is transmitted more than once through several blue light transmitting walls of successive light transmitting cells and as such the blue color is intensified at every passage of such a wall. This effect is experienced by user as a pleasant skylight appearance.

In an embodiment, a ratio between a diameter of the light transmitting channel and a length of the light transmitting channel is larger than 0.2. The diameter of the light transmitting channel is defined as an average of the length of all possible imaginary straight lines through a centre point of the light transmitting channel from a point at the wall to another point at the wall along an imaginary plane parallel to the light input window. The length of the light transmitting channel is defined as an average of the distance between the light input window and the light exit window measured along lines being parallel to the wall. To prevent too much glare, not too much light should be emitted at light emission angles which are larger than 60 degrees (for example, less than 1000 nits or candela per square meter). If the ratio is larger than 0.2, which means that the light transmitting channel is relatively flat, not too much light impinges at the walls and as a consequence not too much light is reflected or diffusely reflected and emitted through the light exit window at angles larger than 60 degrees, or even at smaller light emission angles, for example, 30 degrees. It is to be noted that the light emission at relatively large light emission angles also depends on the characteristics of the light source. If the light source emits only a minor amount of light at relatively large light emission angles, not much light falls on the walls. If the light source emits a substantial amount of its emitted light at relatively large light emission angles, the walls will reflect, in relative terms, much more light. Thus, the ratio should also be adapted to the characteristics of the light source.

In yet another embodiment, a ratio between a diameter of the light transmitting channel and a length of the light transmitting channel is larger than 0.5.

In an embodiment, the ratio between a longest linear distance of the light transmitting channel and a height of the light transmitting channel is larger than 1.0.

In another embodiment, a shape of a cross-section of the light transmitting channel along an imaginary plane parallel to the light input window is one of: a circle, an ellipse, a triangle, a square, a rectangle, or a hexagon. If a light transmitting channel has a shape according to the embodiment, a space efficient optical element may be created. Further, if a plurality of light transmitting cells are placed in a raster structure and the light transmitting cells have a light transmitting channel of such a shape, the plurality of light transmitting cells may be placed very efficiently in the raster structure without losing a lot of space in between the light transmitting cells.

In an embodiment, the optical element further comprises a light diffuser and/or a further light diffuser. The light diffuser is placed at the light exit window of the light transmitting cell for diffusing the light being emitted through the light exit window. The further light diffuser is placed at the light input window for diffusing light being emitted through the light input window. The light diffuser and/or the further light diffuser should weakly diffuse the light. The weak light diffuser contributes to a more smooth transition between (white) light which directly originates from the light source and the more bluish light, and may result, if used in front of a raster of a plurality of light transmitting cells, into a more uniform light emission and hiding the edges of the walls.

It is to be noted that the diffuser may also be placed at a limited distance from the exit window. This results in a better masking of the cell walls, as light has the distance in air to mix. The diffuser may also be laminated to the channels; this is low-cost since then there is no need for a mechanically stiff substrate for the diffuser.

Note that in cases where a point light source, such as LEDs, without additional optics are used, the diffuser helps to mask the point-like and very bright appearance of the point light source. Also, in case the light transmitting channels have transmissive walls, at larger angles the individual point light sources will become hardly visible due to the many reflections and transmissions of the light by the interfaces between the light transmitting channels and the walls. This is a considerable advantage.

A further light diffuser may also be located at the light input window of the light transmitting cell in order to mask the very bright point-like nature of a point light source.

A benefit of a light diffuser or a further light diffuser directly applied to the light exit window or the light input window, respectively, is that they diffuser further provides mechanical stiffness to the light transmitting cell. In another embodiment, the light diffuser and/or the further light diffuser increase the full width half maximum (FWHM) angle of an angular light emission distribution being transmitted through the light diffuser not more than 20°.

If the light diffuser diffuses too much, which means that the angle of the angular light distribution is increased too much, the skylight appearance generated by the optical element is cancelled, because the (white) light directly originating from and the more bluish light the light source are mixed too much at all light emission angles. Thus, the diffusion should be kept within acceptable limits and thus the maximum increase of the FWHM angle of the angular light distribution is 20°.

The light diffuser and the further light diffuser may also be an anisotropic diffuser, which means that an increase in the FWHM angle is larger in some directions than in others; e.g. 5° in the x-direction and 10° in the y-direction.

In an embodiment, the light diffuser and/or the further light diffuser increase the full width half maximum (FWHM) angle of an angular light distribution being transmitted through the weak light diffuser not more than 10°.

In yet another embodiment, the light diffuser and/or the further light diffuser increase the full width half maximum (FWHM) angle of an angular light distribution being transmitted through the weak light diffuser not more than 5°.

According to a second aspect of the invention, a lighting system is provided which comprises a light source and an optical element according to the first aspect of the invention. The light source is configured to emit light towards the light input window of the optical cell of the optical element.

The lighting system according to the second aspect of the invention provides the same benefits as the optical element according to the first aspect of the invention and has similar embodiments with similar effects as the corresponding embodiments of the optical.

In an embodiment, the light source is configured to emit light at a color point. The color point is a point close to a blackbody line of a color space. Thus, the light source emits white light. Direct sunlight is also light at a certain color point close to the black body line of a color space. In an advantageous embodiment, the color point is a point on the blackbody line because light of such a color point corresponds to white light. In the embodiment, the color point may also be close to the black body line because the color point of sunlight which has been transmitted through the atmosphere may also deviate slightly from light with a color point exactly on the black body line. The color space is, for example, the CIE xyz color space.

According to a third aspect of the invention, a luminaire is provided which comprises the optical element according to the first aspect of the invention or comprises the lighting system according to the second aspect of the invention.

The luminaire according to the third aspect of the invention provides the same benefits as the optical element according to the first aspect of the invention and has similar embodiments with similar effects as the corresponding embodiments of the optical element.

These and other aspects of the invention are apparent from and will be elucidated with reference to the embodiments described hereinafter.

It will be appreciated by those skilled in the art that two or more of the above-mentioned embodiments, implementations, and/or aspects of the invention may be combined in any way deemed useful.

Modifications and variations of the optical element, the lighting system or the luminaire, which correspond to the described modifications and variations of the optical element, can be carried out by a person skilled in the art on the basis of the present description.

Figure 1:
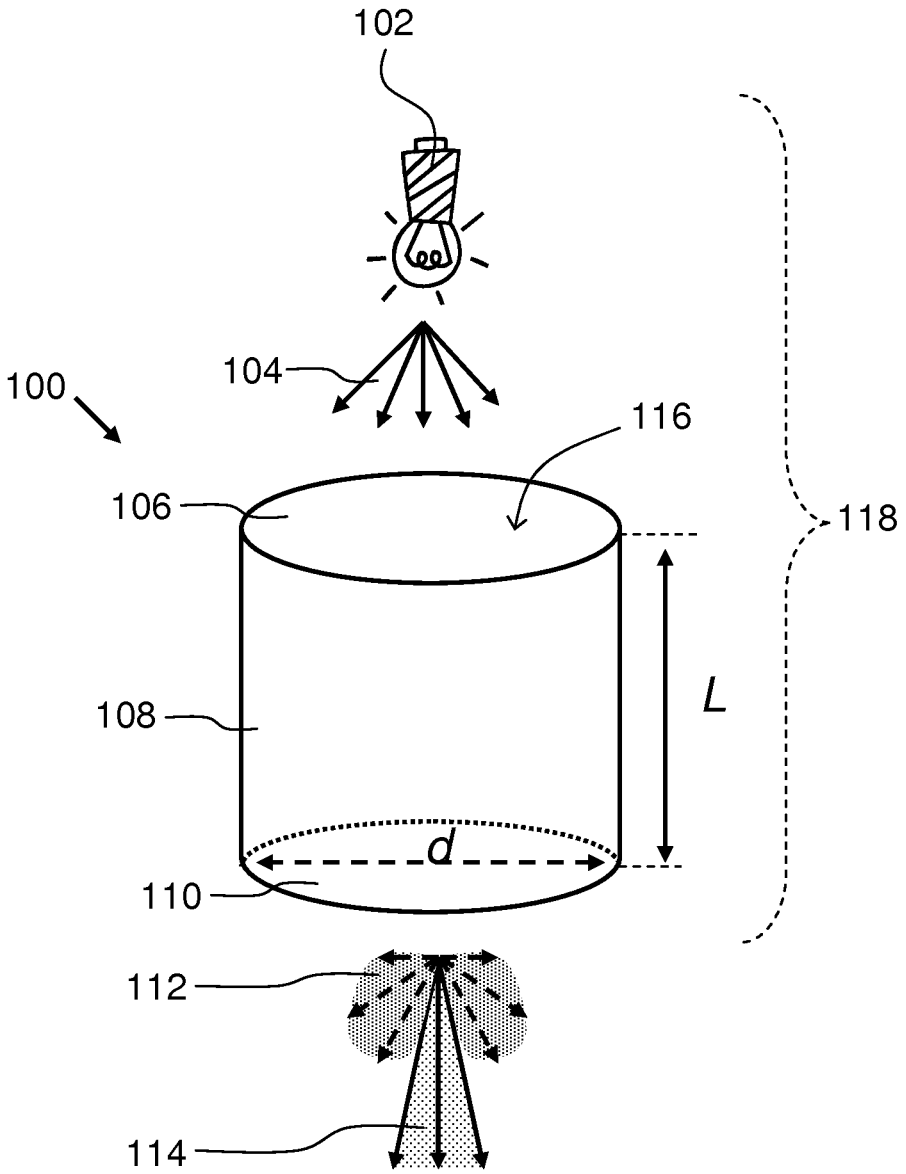
FIG. 1 schematically shows an optical element according to the first aspect of the invention and schematically shows a lighting system according to the second aspect of the invention, FIG. 2 schematically shows another embodiment of an optical element according to the first aspect of the invention, FIG. 3 schematically shows a cross-section of an optical element comprising a plurality of light transmitting cells, FIG. 4*a* schematically shows an alternative embodiment of an optical element, FIG. 4*b* schematically shows another alternative embodiment of an optical element, FIG. 5*a* schematically shows an embodiment of the optical element comprising a plurality of light transmitting cells in a raster structure, FIG. 5*b* schematically shows another embodiment of the optical element comprising a plurality of light transmitting cells in another raster structure, FIG. 6*a* schematically shows a cross-section along a plane parallel to light input windows of an embodiment of an optical element which comprises a plurality of light transmitting cells, FIG. 6*b* schematically shows a cross-section of another embodiment of an optical element which comprises a plurality of light transmitting cells, FIG. 6*c* schematically shows a cross-section of a further embodiment of an optical element which comprises a plurality of light transmitting cells, and FIG. 7 schematically shows a luminaire according to a third aspect of the invention.

It should be noted that items denoted by the same reference numerals in different Figures have the same structural features and the same functions, or are the same signals. Where the function and/or structure of such an item have been explained, there is no necessity for repeated explanation thereof in the detailed description.

The figures are purely diagrammatic and not drawn to scale. Particularly for clarity, some dimensions are exaggerated strongly.

DETAILED DESCRIPTION

A first embodiment of an optical element 100 is shown in FIG. 1. The optical element 100 forms together with a light source 102 a lighting system 118. The optical element 100 comprises a light transmitting cell which comprises a light input window 106, a light output window 110, a light transmitting channel 116 and a wall 108. The wall 108 encloses the light transmitting cell 116 and is interposed between the light input window 106 and the light output window 110. The light input window 106 receives light 104 from the light source 102. The light 104 which is emitted by the light source 102 has certain characteristics, like a specific color point in a color space (e.g. the CIE xyz color space) and the light 104 is emitted within a specific angular light emission distribution. The light transmitting channel 116, formed by the wall 108 transmits a collimated part of the light 104 which is received via the light input window 106 from the light source 102. This part is emitted through the light exit window 110 as a collimate light beam 114 which comprises light with the same color as the light 104 emitted by the light source 102. Another part of the light 104 that is received from the light source 102 via the light input window 106 impinges on a surface of the wall which faces towards the light transmitting channel 116. A part of the wall 108 on which light impinges on or through which light is transmitted is at least reflective or transmissive, respectively, in a predefined spectral range. The predefined spectral range is such that a part of the light which is emitted by the light transmitting cell through the light exit window at relatively large light emission angles is blue. The light emission angle is defined with respect to the normal to the light exit window. Thus, if the light 104 which is emitted by the light source 102 is white, the predefined spectral range mainly comprises blue. Thus, the inner surface of the wall 108 is blue if the inner surface of the wall 108 is reflective. If the wall is (partly or fully) transmissive, the inner surface of the wall 108 is blue or the interior of the wall 108 is blue. Thus, light which impinges on the inner surface of the wall is reflected as blue light or transmitted through the wall as blue light, which results in a light emission of blue light 112 at relatively large light emission angles.

Thus, the optical element 100 emits light 114 with the same color point as the light 104 of the light source 102 at relatively small emission angles with respect to the normal to the light exit window 110, and emits blue light 112 at relatively large light emission angles with respect to the normal to the light exit window 110. Such light is experienced by humans as a skylight appearance. The collimated light beam 114 is experienced as direct sunlight, while the more blue light 112 is experienced as the more diffuse blue light that is also presents in daylight.

The light source 102 emits light of a specific color distribution, in other words, the light source emits light of a specific color point. In an embodiment, the specific color point of the light source 102 is a point in a color space close to a blackbody line of a color space. Direct sunlight has also a color point on or close to the blackbody line. Consequently, if the light source 102 emits light at a color point close to the blackbody line, viewers experience the collimated light beam 114 as direct sunlight.

The light transmitting channel 116 has a length L, which is the shortest distance from the light input window 106 to the light output window 110 along the wall 108. The light transmitting channel 116 has a diameter d which is an average diameter of the light transmitting channel 116 measured in an imaginary plane being parallel to the light input window 106. The ratio between the diameter d and the length L is larger than 0.2 to obtain a certain collimation of the light 104 received from the light source 102 and to obtain a certain amount of blue light 112 at relatively large light emission angles. Especially, the amount of light emitted at light emission angles larger than 60 degrees should be limited to prevent too much glare.

Figure 2:
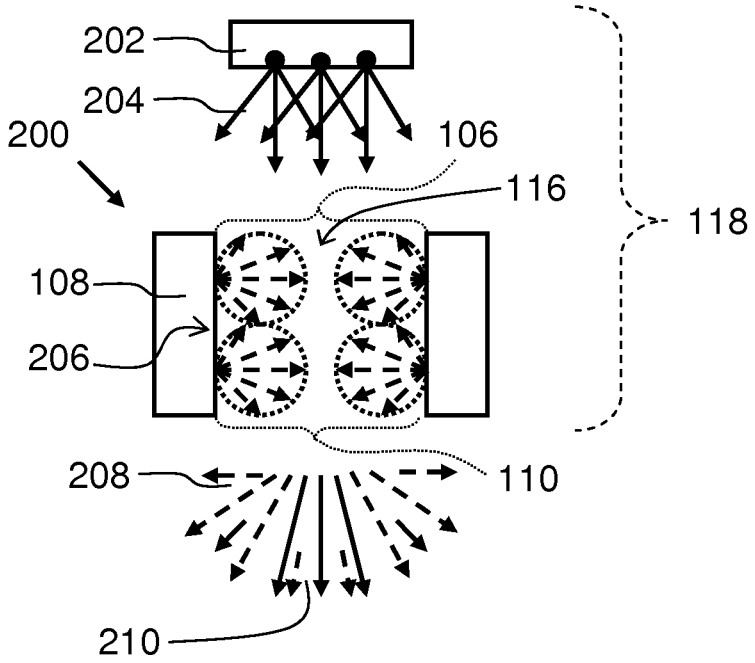

FIG. 2 schematically presents a cross-section of an optical element 200. The optical element 200 has a light input window 106, a light output window 110, a wall 108, and a light transmitting channel 116. The inner surface 206 of the wall 108 is diffusely light reflective and has a blue color. If a light beam impinges on a specific point of the inner surface 206, the light is filtered and becomes blue light and the light is diffusely reflected. The specific point of the inner surface 206 operates as a local Lambertian blue light source, as shown in the figure. As such, most light which is diffusely reflected exits the light exit window 110 at relatively large light emission angles 208. At relatively small light emission angles 210 only a small amount of blue light is emitted. The optical element 200 receives light 204 of a light source 202 which emits the light 204 along an area. Each point of the light emitting area of the light source 202 acts as a point source. The light source 202 and the optical element 200 form a lighting system 118.

Figure 3:
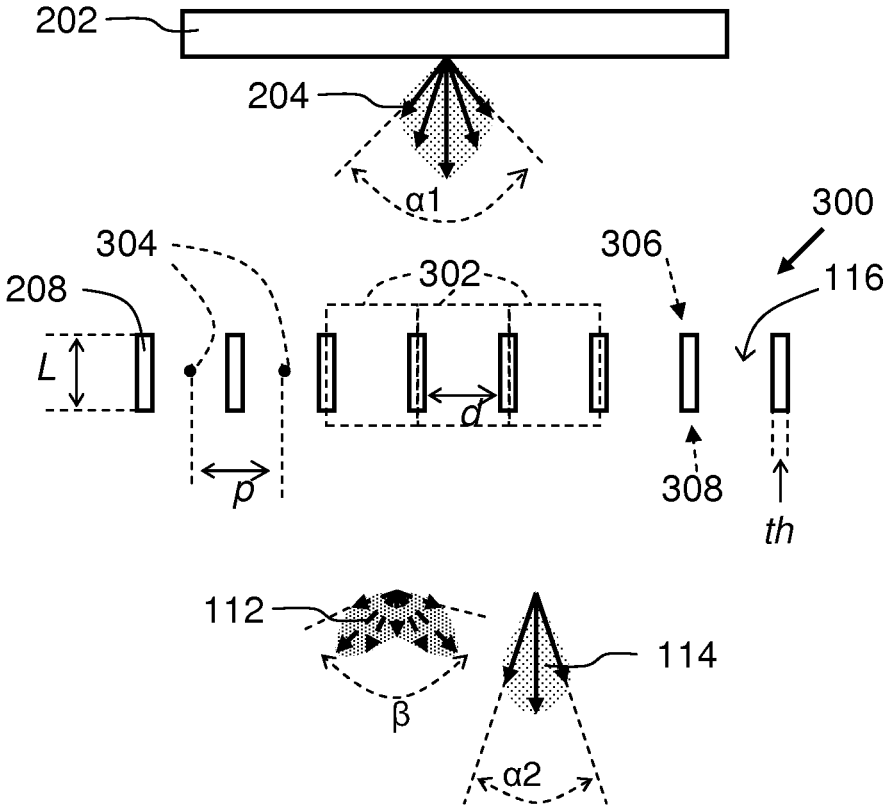

FIG. 3 schematically shows a cross-section of an optical element 300 which comprises a plurality of light transmitting cells 302. The plurality of light transmitting cells 302 share walls 208 and light transmitting channels 116 are present between the shared walls 208. Each one of the light transmitting cells 302 operates in the same way as the optical elements of FIG. 1 or FIG. 2. The optical element 300 is a layer with the plurality of cells and may be placed in front of a flat light source 202 which emits light 204 in a specific angular light emission distribution having a Full Width Half Maximum (FWHM) angle $\alpha_1$. The light transmitting cells 302 collimate a part of the light 204 that is received from the flat light source 202 towards a collimated light beam 114 which has a FWHM angle of $\alpha_2$. It is to be noted that $\alpha_2<\alpha_1$. Further, the optical element 300 emits blue light 112 at relatively large light emission angles. The angular light emission distribution of the blue light 112 may have relatively low amounts of light at small light emission angles, and the angular light emission distribution has a maximum light emission $\beta$. It is to be noted that $\beta>\alpha_1$. Light that is a combination of the collimate light beam 114 and the blue light 112 at large light emission angles is experienced as pleasant artificial skylight.

Each one of the light transmitting channels 116 has a length L and an average diameter d. As discussed previously, the ratio between the diameter d and the length L should be larger than 0.2. In an embodiment, the ratio is larger than 0.5. In another embodiment, the ratio is larger than 1.0.

The plurality of light transmitting cells 302 are placed with respect to each other at a certain pitch p. The pitch p is defined as the shortest distance from a center point 304 of a light transmitting cell 302 to a center point 304 of a neighboring light transmitting cell 302. The walls 208 have a certain thickness th. The thickness th of a wall 208 is defined as the shortest distance from a surface of the wall 208, which is facing towards a specific light transmitting channel 116, towards another surface of the wall 208, which is facing towards a neighboring light transmitting channel 116. The thickness th of the walls 208 should be smaller than ⅓ of the pitch p of the raster structure in which the plurality of light transmitting cells 302 are placed. The thickness th of the walls 208 have to be limited because the walls 208 contribute to an inefficiency of the optical element 300, because light 204 of the light source 202, which impinges on an edge 306 of the wall 208 that is facing towards the light source 202, is not transmitted through the optical element 300. Further, another edge 308 of the walls 208 that is facing towards viewer is seen by the viewer and disturbs the skylight appearance created by the optical element 300.

In an embodiment, the thickness th of the walls 208 is smaller than ⅙ of the pitch p of the raster structure. In yet another embodiment, the thickness th of the walls 208 is smaller than ⅑ of the pitch p of the raster structure.

In an embodiment, the edge 306 of the wall 208 that is facing towards the light source 202 is reflective or white diffusely reflective. This light is than reflected back to the light source 202 and may be recycled in the sense that the light source 202 may reflect the light back to the optical element 300.

In the optical element 300 of FIG. 3 the light transmitting cells have an open light transmitting channel, which means that no specific material is placed at the light input window or at the light exit window. This provides a further advantage of sound absorption. The optical element 300 may also be used, for example, in an office environment to limit the sound levels in the office.

Figure 4A:
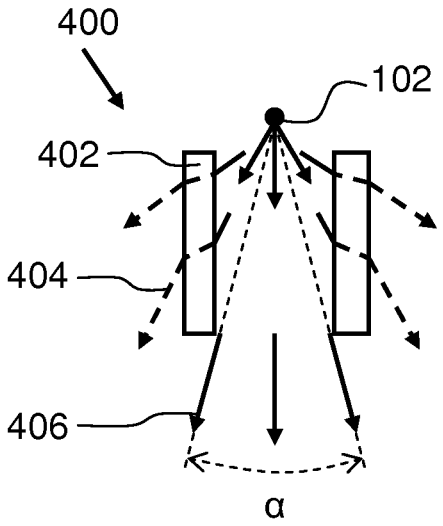

FIG. 4*a* schematically presents an optical element 400 comprising one light transmitting cell that comprises blue transparent walls 402. The light source 102, depicted as a point source, emits substantially white light into the light transmitting cells. Light with light emission angles within the depicted angle α is transmitted through the light transmitting cells without being disturbed. Light from the light source 102 outside the angle α impinges on the blue transparent wall 402 and is transmitted through the wall which absorbed color components complementary to blue. The light 404 has an enhanced blue color component, which means that the light 404 has a more saturated blue color than the light which is received from the light source 102. Thus, in line with previous embodiment, the optical element 400 emits white light 406 at relatively small light emission angles, and emits blue light 404 at relatively large light emission angles, and thus is a skylight appearance created.

It is to be noted that a part of the light exit window is opposite the light input window, and a part of the light exit window is formed by the transparent walls 402. Through the part opposite the light input window is transmitted the light 406 that directly originates from the light source, and through the part of the light exit window that is formed by the transparent walls 402 the blue light 404 is transmitted. It is further to be noted that the walls 402 may be partly reflective and partly transmissive and in that case blue light is also transmitted through the part of the light exit window being opposite the light input window. However, the light emitted through the light exit window at relatively large light emission angles will be blue. Further, if in an optical element like the optical element of FIG. 3 all walls would be light transmissive in a blue spectral range, each light exit window also emits blue light (which is received via the walls of a neighboring cell). Also in this situation the blue light is mainly emitted at relatively large light emission angles.

Figure 4B:
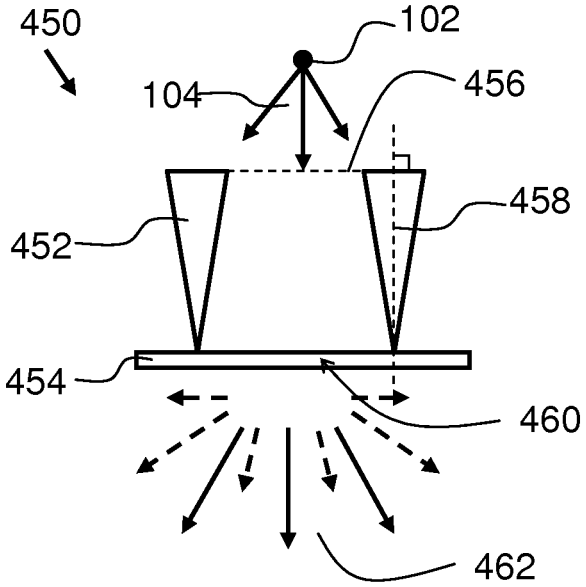

FIG. 4*b* schematically presents an alternative optical element 450. The walls 452 of the light transmitting cell of the optical element 450 taper in a direction from the light input window towards the light output window. This may be advantageous because the view does not see an edge of the walls 452 when viewing towards the optical element 450. Further, as also shown in other embodiments, the central line 458 of the walls 452 is substantially perpendicular to the light input window 456. At another side of the light transmitting cell is a light exit window 460 which is substantially parallel to the light input window 456. The light exit window 460 is covered with a diffusing layer 454. The diffusing layer 454 is a weak diffuser, which means that the diffusing layer 454 does not increase a full width half maximum (FWHM) angle of an angular light emission distribution being transmitted through the diffusing layer 454 with more than 20°. The diffusion should be weak to prevent that the light 104 which directly originates from the light source 102 is mixed too much with the bluish light that is reflected by the walls 452. However, the weak diffusion of the diffusing layer 454 is advantageous to obtain a light emission distribution 462 which has a smooth transition between light 104 which directly originates from the light source 102 and the bluish light that is reflected by the walls 452. The light diffuser 454 may also be placed at a short distance from the light exit window.

Figure 5A:
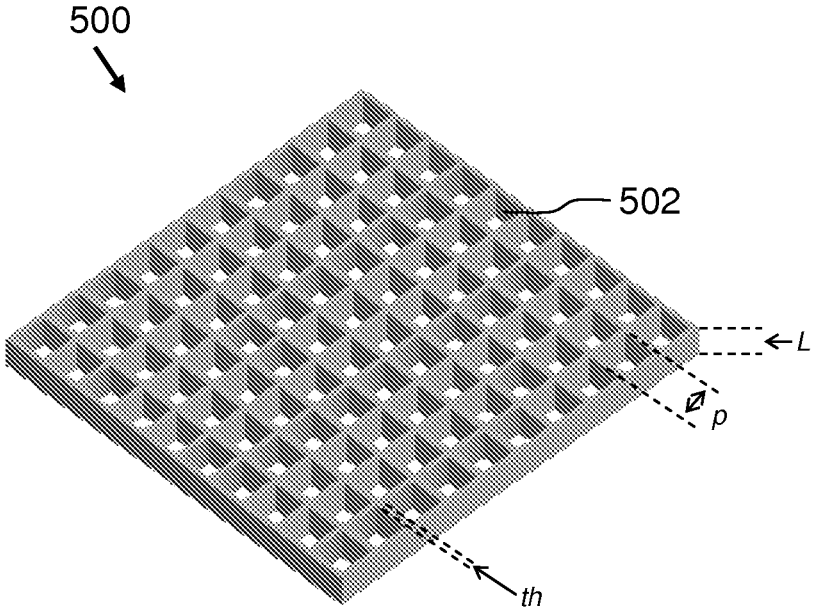

FIG. 5*a* presents an optical element 500 which comprises a plurality of light transmitting cells 502 in a raster structure. A shape of a cross-section of the light transmitting cells 502 is square. Further, the walls of the light transmitting cells 502 are blue and may be made of a synthetic blue material. The optical element 500 may be manufactured with an injection molding process. Previously discussed parameters of the raster structure and the light transmitting cells 502, like the pitch p, the thickness th of the walls and the length L of the light transmitting channels are indicated as well.

It is to be noted that the walls of the optical element 500 may be transparent, reflective, or diffusely reflective. If the walls are transparent, the viewer sees a more dark blue color at larger viewing angles (defined with respect to a normal to a part of light exit window that is opposite the light input window) because light rays at these angles are transmitted through a plurality of successive walls, at each wall the blue color is intensified.

Figure 5B:
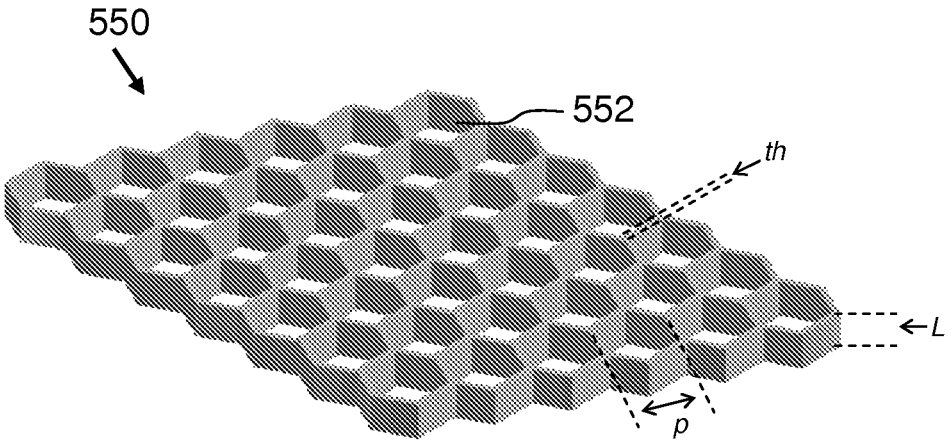

FIG. 5*b* presents another optical element 550 which comprises a plurality of light transmitting cells 552 in a raster structure. A shape of a cross-section of the light transmitting cells 552 is hexagonal. Further, the walls of the light transmitting cells 552 are blue and may be made of a synthetic blue material. The optical element 550 may be manufactured with an injection molding process. Previously discussed parameters of the raster structure and the light transmitting cells 552, like the pitch p, the thickness th of the walls and the length L of the light transmitting channels are indicated as well.

In an embodiment (not shown), some of the surfaces of the walls have another color than blue to present an image to a viewer which looks towards the optical element 552. In other words, some cells of the plurality of cells 552 have walls of another color. A viewer which looks, for example, at an angle of 60 degrees towards the optical element 552 mainly sees walls of the cells 552 and does not receive any direct light from a light source because of the relatively large viewing angle. Thus, the viewer sees the different colors of the different colored cells and experiences the combination of them as an image. The image is, for example, an emergency sign indicating an emergency exit, or may be an image of clouds in the sky which enhances the skylight appearance.

In another embodiment (not shown), the walls have a color gradient, for example from white close to the light input window to blue at the light exit window. This creates a smooth transition towards more saturated blue colors when the viewer looks towards the optical element at larger viewing angles.

Figure 6A:
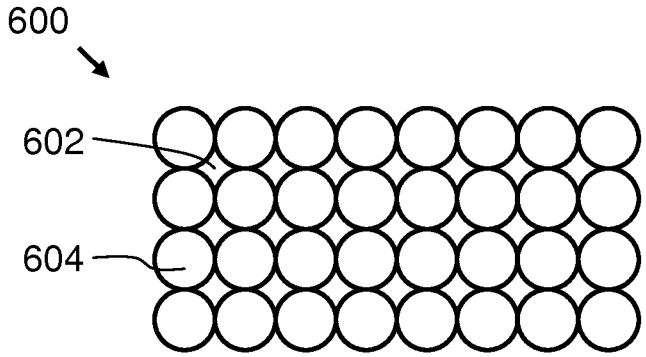

FIG. 6*a* presents a cross-section of another embodiment of an optical element 600 which comprises a plurality of light transmitting cells 602, 604. The optical element 600 may be manufactured by gluing sections of blue tubes together. The spaces within the small sections of the tubes become circular shaped light transmitting cells 602 and the spaces in between a plurality of sections of blue tubes become light transmitting cells 604 with another shape. A similar optical element is obtained if sections of tubes are used that have, seen in a cross-section, a cylindrical shape, or which have another shape.

Figure 6B:
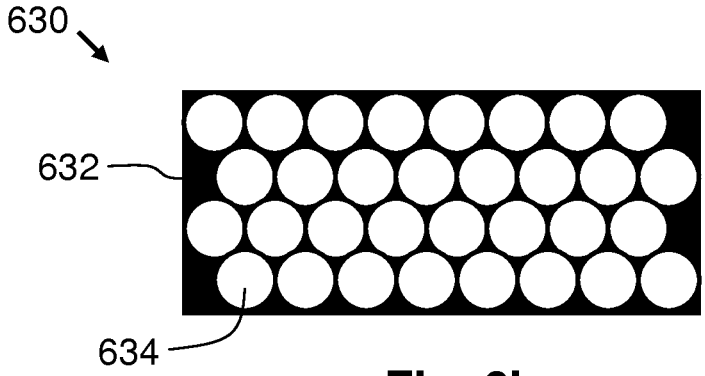

FIG. 6*b* presents another cross-section of a further embodiment of an optical element 630 which comprises a plurality of light transmitting cells 634. The optical element 600 may be manufactured by drilling holes in a plate 632 of blue synthetic material. The holes form the light transmitting cells 634.

Figure 6C:
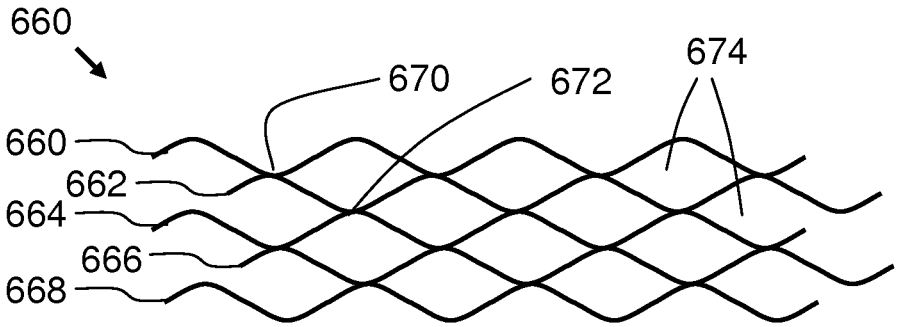

FIG. 6*c* presents a further cross-section of yet another embodiment of an optical element 660 which comprises a plurality of light transmitting cells 674 in a raster structure. The optical element 660 is manufactured of a stack of blue layers 660, 662, 664, 666, 668. The blue layers 660, 662, 664, 666, 668 may be transparent or diffusely reflective. The optical element 600 is manufactured by starting with a first blue layer 660 on top of which a second blue layer 662 is placed. The first blue layer 660 and the second blue layer 662 are locally glued together, as, for example, shown at a position indicated with 670. Thereafter a third blue layer 664 is place on top of the first and second blue layer 660, 662. The third blue layer 664 is locally glued to the second blue layer 662 at specific points which are different from the points at which the first blue layer 660 and the second blue layer 662 are glued together. Such a different position is, for example, indicated with 672. This is repeated with subsequent layers 666, 668. After gluing the successive layers together, the stack of layers is stretched out to obtain the structure of FIG. 6*c*. It is to be noted that the act of stretching out may be performed separately of the act of gluing the successive layers together, and as such the intermediate product of a non-stretched stack of layers has a relatively small volume and may be stored efficiently.

Figure 7:
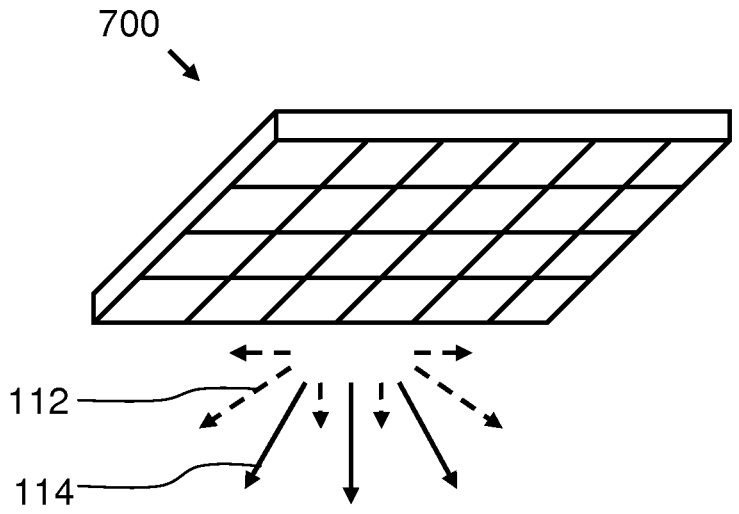

FIG. 7 schematically shows an embodiment of a luminaire 700 according to the third aspect of the invention. The luminaire 700 comprises an optical element according to one of the previous embodiments. The optical element is schematically shown in FIG. 7 with the raster structure at the light emitting surface of the luminaire 700. The luminaire further comprises a flat light source which emits light along a relatively large surface.

It should be noted that the above-mentioned embodiments illustrate rather than limit the invention, and that those skilled in the art will be able to design many alternative embodiments without departing from the scope of the appended claims.

In the claims, any reference signs placed between parentheses shall not be construed as limiting the claim. Use of the verb "comprise" and its conjugations does not exclude the presence of elements or steps other than those stated in a claim. The article "a" or "an" preceding an element does not exclude the presence of a plurality of such elements. In the device claim enumerating several means, several of these means may be embodied by one and the same item of hardware. The mere fact that certain measures are recited in mutually different dependent claims does not indicate that a combination of these measures cannot be used to advantage.

The invention claimed is:

1. An optical element for use in front of a light source for obtaining a skylight appearance, the optical element comprising a plurality of light transmitting cells arranged in a raster structure, light transmitting cells comprising:

a light transmitting channel for collimating a part of light emitted by the light source, a light input window at a first side of the light transmitting channel for receiving light from the light source, a light exit window for emitting light with the skylight appearance, at least a part of the light exit window being arranged at a second side of the light transmitting channel opposite to the first side, and a wall interposed between the light input window and the part of the light exit window, the wall enclosing the light transmitting channel, at least a part of the wall being transmissive in a predefined spectral range for obtaining a blue light emission at relatively large light emission angles with respect to a normal to the part of the light exit window the optical element being a stretched-out stack of elongated layers wherein pairs of successive layers are joined together at a plurality of points, successive pairs of successive layers are joined together at different points, the layers form the walls of light transmitting channels, and the light transmitting channels are formed by spaces between two successive layers of the stretched-out stack of elongated layers.

2. An optical element according to claim 1, wherein a ratio between a diameter (d) of the light transmitting channel and a length (L) of the light transmitting channel is larger than 0.2.

3. A lighting system comprising a light source and the optical element according to claim 1, wherein the light source being configured to emit light towards the light input windows of said light transmitting cell of the optical element.

4. A lighting system according to claim 3, wherein the light source being configured to emit light at a color point, the color point being a point close to a blackbody line of a color space.

5. An optical element, according to claim 1, wherein said walls are of a blue transparent synthetic material.

6. An optical element according to claim 1, wherein said walls comprise sections of blue tubes and the sections of blue tubes are glued together.

7. An optical element according to claim 1, further comprising a light diffuser at said light exit windows for diffusing the light being emitted through said light exit window and/or further comprising a further light diffuser at said light input windows for diffusing light being emitted through said light input windows.

8. An optical element, according to claim 1, wherein the light diffuser and/or the further light diffuser increases a full width half maximum [FWHM] angle of an angular light emission distribution being transmitted through the light diffuser not more than 20°.

9. An optical element according to claim 1, wherein the light diffuser and/or the further light diffuser increases a full width half maximum [FWHM] angle of an angular light emission distribution being transmitted through the light diffuser not more than 10°.

10. An optical element according to claim 1, wherein the light diffuser is arranged at a limited distance from said light exit windows for masking said walls of said light transmitting cells.

11. An optical element according to claim 1, wherein a shape of a cross-section of said light transmitting channel along an imaginary plane parallel to the light input window is one of: a circle, an ellipse, a triangle, a square, a rectangle, or a hexagon.

12. An optical element according to claim 1, wherein a ratio between a diameter (d) of the light transmitting channel and a length (L) of the light transmitting channel is larger than 0.5.

13. An optical element according to claim 1, wherein a thickness of said wails is smaller than ⅓ of a pitch of the raster structure, wherein the pitch of the raster structure is defined by the distance from a center point of a light transmitting channel to a center point of the neighboring light transmitting channel, and the thickness of the wall is defined as the shortest distance from a surface of the wall facing towards the light transmitting channel to another surface of the wall facing towards a neighboring light transmitting channel.

14. An optical element for use in front of a light source for obtaining a skylight appearance, the optical element comprising a plurality of light transmitting cells arranged in a raster structure, the light transmitting cells comprising:

a light transmitting channel for collimating a part of light emitted by the light source;

a light input window at a first side of the light transmitting channel for receiving light from the light source;

a light exit window for emitting light with the skylight appearance;

at least a part of the light exit window being arranged at a second side of the light transmitting channel opposite to the first side;

a wall interposed between the light input window and the part of the light exit window, the wall enclosing the light transmitting channel and being blue, at least a part of the wall being transmissive in a predefined spectral range for obtaining a blue light emission and transmissions at relatively large light emission angles with respect to a normal to the part of the light exit window.

* * * * *